United States Patent [19]

Knight et al.

[11] Patent Number: 4,986,206

[45] Date of Patent: Jan. 22, 1991

[54] BILGE DRAIN VALVE

[75] Inventors: Dereck I. Knight; Dennis A. Rule, both of Bournemouth, England

[73] Assignee: The Secretary of State for Defense, London, England

[21] Appl. No.: 358,803

[22] Filed: May 31, 1989

Related U.S. Application Data

[63] Continuation of PCT GB87/00882 filed Dec. 14, 1987.

[30] Foreign Application Priority Data

Dec. 19, 1986 [GB] United Kingdom ..... 8630454

[51] Int. Cl.[5] ..... B63B 13/00

[52] U.S. Cl. ..... 114/183 R; 137/397

[58] Field of Search ..... 114/197, 198, 185, 183 R; 137/397, 398, 409, 496, 81.2; 251/84, 159, 170

[56] References Cited

U.S. PATENT DOCUMENTS

| | | | |
|---|---|---|---|
| 271,060 | 1/1883 | Graham | 114/185 |
| 3,180,301 | 4/1965 | Keller | 114/185 |
| 3,188,994 | 6/1965 | Dawson | 114/197 |

FOREIGN PATENT DOCUMENTS

| | | |
|---|---|---|
| 2415623 | 10/1975 | Fed. Rep. of Germany . |
| 121806 | of 1919 | United Kingdom . |
| 234277 | 5/1925 | United Kingdom . |
| 726875 | 3/1955 | United Kingdom . |

*Primary Examiner*—Sherman Basinger
*Assistant Examiner*—Jesûs D. Sotelo
*Attorney, Agent, or Firm*—Nixon & Vanderhye

[57] ABSTRACT

A drain valve for a vessel having a bilge (4) which is elevated above external water level when the vessel is floating in unladen condition. The valve comprises a drain cylinder (1) located in a drain port (2) and attached at its upper end to the bilge; the cylinder axially containing a spindle bearing (14) in which is slideably located a spindle (20) of a buoyant closure member (32) engageable with the lower end of the cylinder. Opening and closing of the valve is controlled by the pressure differential existing between external and internal water levels.

5 Claims, 1 Drawing Sheet

BILGE DRAIN VALVE

This application is a continuation of PCT application PCT/GB87/00882 which claims priority from GB No. 86 30455 filed in Great Britain on Dec. 19, 1986.

BACKGROUND OF THE INVENTION

1. Field of the Invention

This invention relates to a self-operating valve suitable for draining a stationary boat or other vessel of a type having sufficient inbuilt buoyancy to ensure that the vessel floats when in unladen condition with an internal floor level, i.e. bilge, which is higher than the external water level, such vessels being hereinafter referred to as an elevated bilge vessel.

2. Discussion of Prior Art

Some self draining bilge valves are shown for use in elevated bilge vessels which comprise a buoyant ball or flap or a membrane which is held in place aginst an appropriately shaped apertured member in the side or bottom of the vessel by external water pressure. When any water collects inside the vessel, the pressure differential engendered by the internal and external water levels controls the opening and closing of the valve, i.e. a higher internal level, herein described as a positive head, generates a positive internal pressure which forces the valve open. Conversely, the valve is forced by a negative head.

Valves of this type have two major requirements, one being that the valve should close firmly so as to prevent ingress of water when the vessel is so laden as to depress the bilge level below the external water level, i.e. negative head, and the other being that the valve will open freely for draining at minimum possible positive head. These two requirements are conflicting, with the result that the majority of known designs tend to be unsatisfactory in one or the other aspect. Further, the rate of draining of such valves is usually slow, making them unsuitable for use in a vessel in which speedy recovery after sudden swamping is required, e.g. a support pontoon for a floating bridge, which can become heavily but temporarily depressed by an overpassing vehicle. A fast drain rate is also essential for speedy deployment of such pontoons which often become completely waterlogged during launch procedure. A further disadvantage of known design is the difficulty of cleaning them from inside the vessel when they become clogged with flotsam.

SUMMARY OF THE INVENTION

The present invention seeks to provide a self operating bilge drain valve of increased drain rate which is less subject to the aforesaid disadvantages.

In accordance with the present invention, a bilge drain valve for an elevated bilge vessel having a drain port communicating downwardly from the bilge to the exterior of the vessel comprises: an open-ended drain cylinder locatable within the drain port having an upper end attachable to the bilge so as to depend vertically therefrom; a support member attached diametrally within the drain cylinder and having a spindle bearing disposed axially therein; and a buoyant closure member having an upwardly extending axial spindle slideably engaged in the spindle bearing and having an upper face engageable with the lower end of the drain cylinder, hte buoyancy of the buoyant closure member being selected to counterbalance the weight of both its own weight and the weight of the volume of water containable in the drain cylinder.

Preferably the buoyant clossure member is weighted to provide gravity-assisted opening so as to minimise the positive head necessary for opening the valve. The buoyancy of he closure member is selected to counterbalance its own weight and the weight of the water contained above it within the drain cylinder, in order that the valve will be speedily and firmly closed by any dry load depression of the bilge level below the external water level, i.e. negative head. The counterbalanced design also ensures that the valve will speedily re-open to drain the vessel of any collected bilge water that rises above the external water level.

The drain cylinder is desirably of large diameter both for rapid drain rate and to minimize risk of blockage. It is also desirably of sufficient size to permit entry of a man's hand for clearance purposes in the event of a major blockage.

The cylinder preferable has a relatively thin wall thickness, or alternatively a chamfered lower end, so as to minimize contact area with the upper face of the closure member and thereby maximise sealing stress. Sealing may also be improved by an annulus of resilient material disposed on the upper face of member so as to be compressed against the lower end of the drain cylinder when the valve is closed.

Conveniently the valve may be provided with a closure locking mechanism for use when the vessel is in motion through the water.

BRIEF DESCRIPTION OF THE DRAWINGS

A specific embodiment of the invention will now be described by way of example only with reference to the accompanying drawings of which

DETAILED DISCUSSION OF PREFERRED EMBODIMENTS

Figure 1:
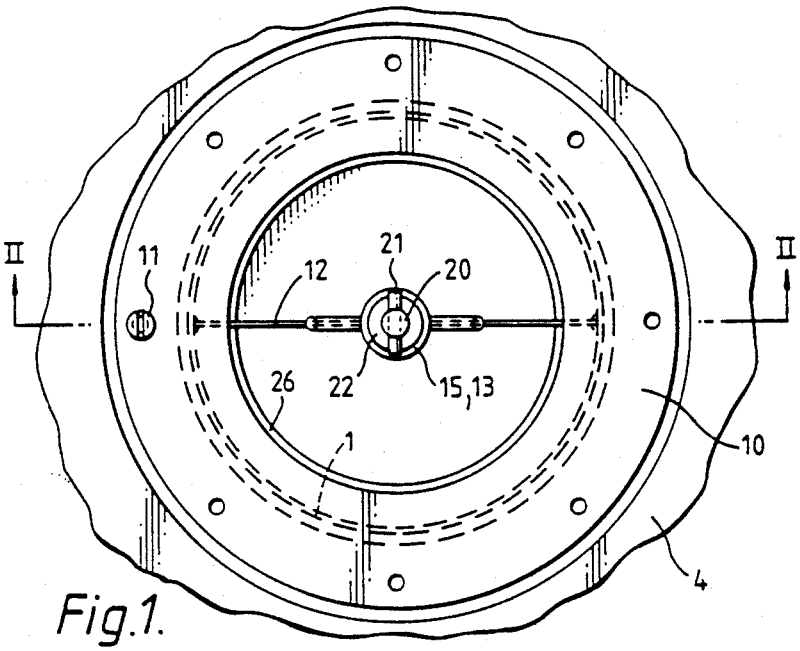
FIG. 1 is a plan view of a bilge drain valve located in a drain port of an elevated bilge vessel and FIG. 2 is an elevation view of the same valve sectioned on line II—II of FIG. 1.
Figure 2:
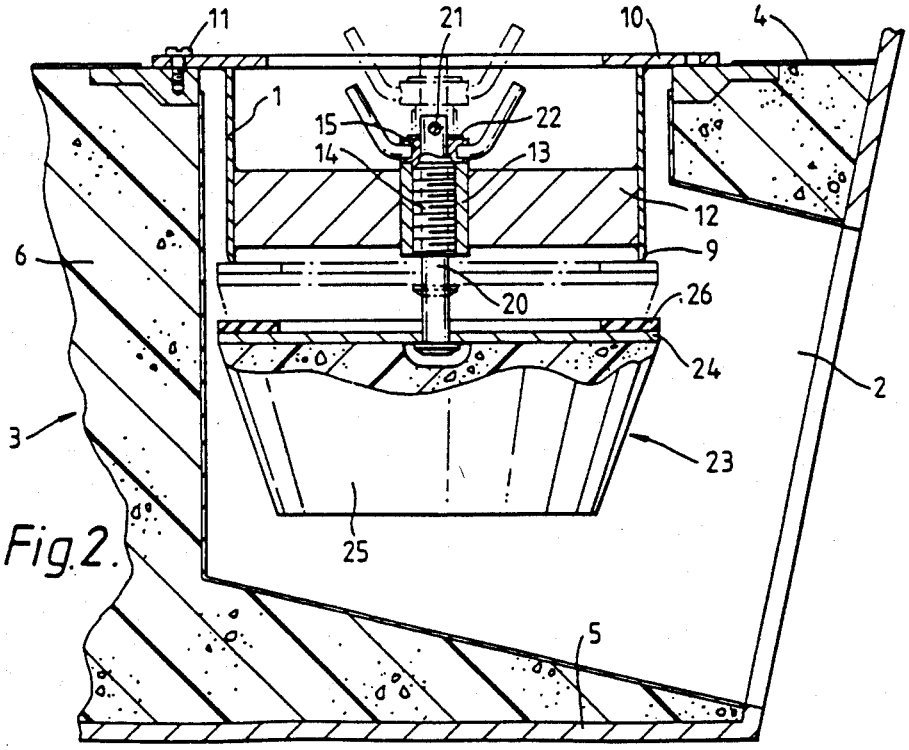

The drain valve illustrated in FIGS. 1 and 2 comprises a drain cylinder 1 which is located in a drain port 2 of an elevated bilge vessel 3, the vessel having a bilge 4 separated from a bottom 5 by an interjacent layer 6 of buoyant material.

The cylinder has a chamfered rim 9 at its lower end and is provided at its upper end with a flange 10 which is attached to the bilge 4 by means of screws 11. The cylinder is also fitted internally with a diametral web 12 which supports an internally threaded tube 13 co-axially located in the cylinder. In screwed engagement with the tube 13 is an externally threaded bearing 14 having a winged head 15 permitting manual adjustment of the height of the bearing with respect to the tube 13 and comprising the locking mechanism.

Slideably located within the bearing 14 and the head 15 is a spindle 20 having a crossbar 21 inserted at its upper end so as to rest upon a washer 22 disposed on the head 15. The lower end of the spindle 20 supports a closure member 23 comprised by a metal disc 24 having a truncated conical float 25 attached to its lower face and a resilient annulus 26 attached to its upper face, the annulus being engageable with the rim 9 of the cylinder 1 when the closure member 23 is urged upwards, either by external water pressure or by manual rotation of the head 15 and bearing 14 to the raised position shown by broken lines in FIG. 2.

For normal self-draining operation the bearing 14 is screwed down to its lowest position relative to the threaded tube 13 to allow the closure member 23 to open to its maximum separation from the rim 9 an hence permit the maximum drain rate. The raised position of the bearing 14 is used for locking the valve in closed condition when the vessel is to be moved through the water.

Two drain valves of the type described in the specific embodiment, each having a 150 mm diameter and an opening height of 25 mm, and operating conjointly in an elevated bilge pontoon, having been found capable of draining 4000 Kg of water in five minutes. The valves, which are leak proof at negative pressure, become opened by a positive head of only 12 mm.

We claim:

1. A bilge drain valve for an elevated bilge vessel having a drain port communicating downwardly from the bilge to the exterior of the vessel comprising:

an open ended drain cylinder (1) locatable within the drain port (2) having an upper end attachable to the bilge so as to depend vertically therefrom;

a support member (12) attached diametrically within the drain cylinder and having a spindle bearing (14) disposed axially therein; and a buoyant closure member (23) having an upwardly extending axial spindle (2)) slideably engaged in the spindle bearing (14) and having an upper face engageable with the lower end of the drain cylinder, the buoyant closure member (23) including a means defining a buoyancy sufficient to counterbalance its own weight and the weight of a volume of water containable in the drain cylinder (1).

2. A drain valve as claimed in claim 1 characterised in that the closure member includes a metal disc (24) coaxially attached to the spindle, having a resilient annulus (26) attached to its upper face so as to be engageable with the drain cylinder (1), and a lower face attached to a float (25).

3. A drain valve as claimed in claim 1 characterised in that the lower end of the drain cylinder (1) is chamfered so as to provide a reduced contact area between the cylinder (1) and the closure member (23).

4. A drain valve as claimed in claim 1 further provided with a closure locking mechanism (13, 14, 15).

5. A drain valve as claimed in claim 4 characterised in that the closure locking mechanism comprises a screw jack (13, 14, 15) axially operative between the spindle bearing (14) and the support member (12) for adjusting the axial location of the bearing (14) within the drain cylinder (1).

* * * * *